US005460343A

United States Patent [19]

Hestilow

[11] Patent Number: 5,460,343

[45] Date of Patent: Oct. 24, 1995

[54] BAG HOLDER

[75] Inventor: Gary P. Hestilow, Midwest City, Okla.

[73] Assignee: Century Martial Arts Supply, Inc., Oklahoma City, Okla.

[21] Appl. No.: 110,145

[22] Filed: Aug. 20, 1993

[51] Int. Cl.[6] ..... A63B 69/00

[52] U.S. Cl. ..... 248/124.1; 248/121; 248/188.1; 482/87

[58] Field of Search ..... 482/86, 87, 89; 248/121, 122, 125, 146, 188.1, 163.1, 188.91

[56] References Cited

U.S. PATENT DOCUMENTS

| | | | |
|---|---|---|---|
| 825,860 | 7/1906 | McKenzie | 482/86 X |
| 2,620,188 | 12/1952 | Malagio | 248/121 X |
| 2,625,356 | 1/1953 | Kennedy et al. | 248/121 |
| 3,034,754 | 5/1962 | Trindl | 248/188.1 X |
| 3,510,131 | 5/1970 | Gardner | 248/163.1 X |
| 3,934,806 | 1/1976 | Rady | 248/188.1 X |
| 4,102,065 | 7/1978 | Selden | 248/122 X |
| 4,557,478 | 12/1985 | Levine | 482/89 |
| 4,635,929 | 1/1987 | Shustack | 482/89 |
| 5,286,241 | 2/1994 | Petrakis | 482/87 |

FOREIGN PATENT DOCUMENTS

| | | | |
|---|---|---|---|
| 1750715 | 7/1992 | U.S.S.R. | 482/87 |

*Primary Examiner*—Alvin C. Chin-Shue
*Assistant Examiner*—Derek J. Berger
*Attorney, Agent, or Firm*—Dunlap & Codding

[57] ABSTRACT

A bag holder adapted to hold a training bag and adapted to be used in a corner with a first wall and a second wall and a floor surface disposed therebetween. The bag holder includes a leg assembly having one portion extending a distance along and engaging the first wall and another portion extending a distance along and engaging the second wall. A bag support is connected to the leg assembly. A portion of the bag support extends a distance upwardly from the leg assembly and another portion of the bag support extends a distance outwardly above the leg assembly terminating with an outward end. The bag assembly is connected to the bag support assembly near the outer end of the bag support assembly.

29 Claims, 4 Drawing Sheets

BAG HOLDER

FIELD OF THE INVENTION

The present invention relates generally to bag holders and, more particularly, but not by way of limitation, to a bag holder having a leg assembly and a bag support assembly where the leg assembly extends along walls forming a corner and the bag support assembly supports a training bag.

DESCRIPTION OF THE PREFERRED EMBODIMENTS

Figure 1:
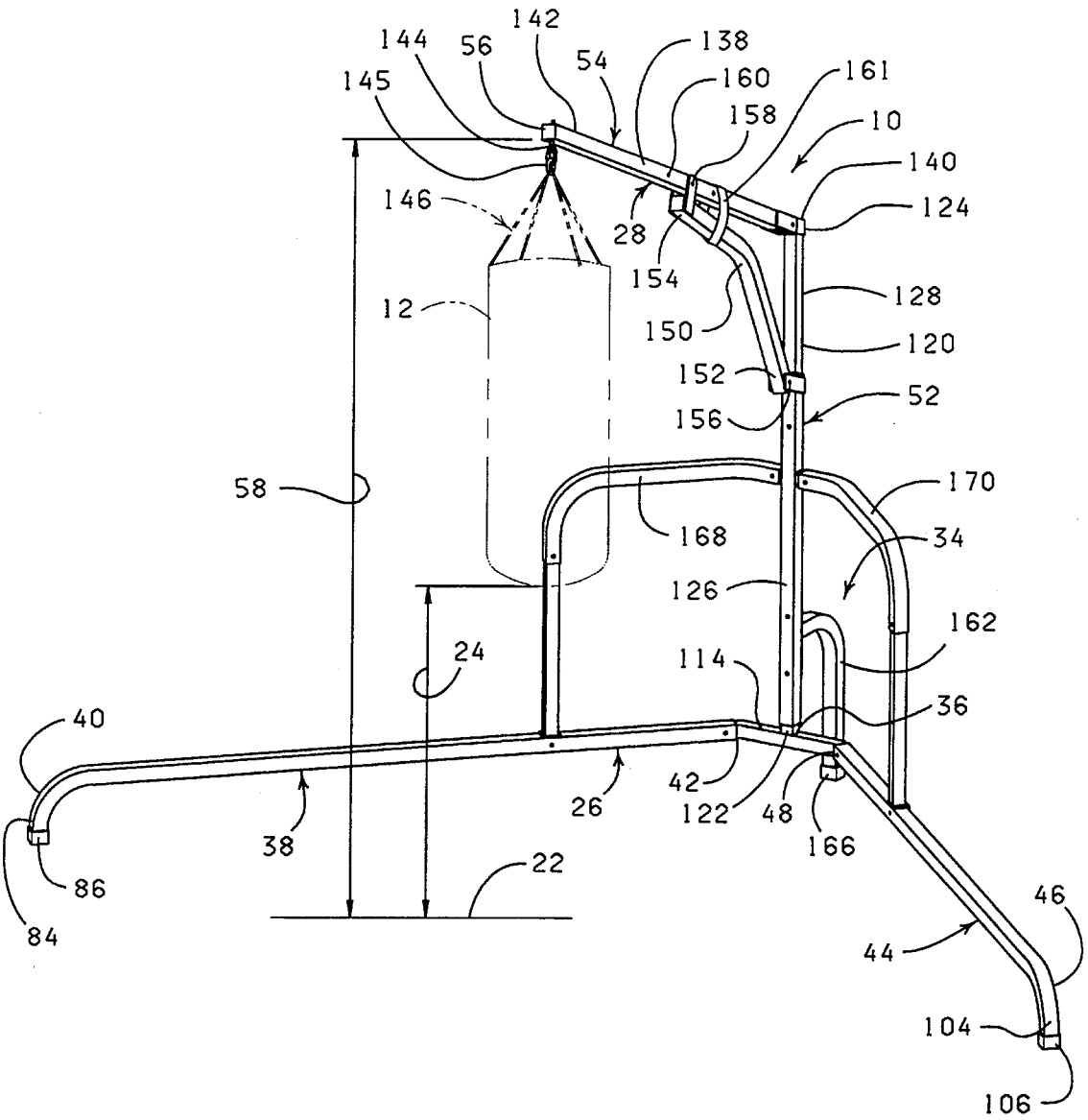
FIG. 1 is a perspective view of a bag holder constructed in accordance with the present invention.
Figure 2:
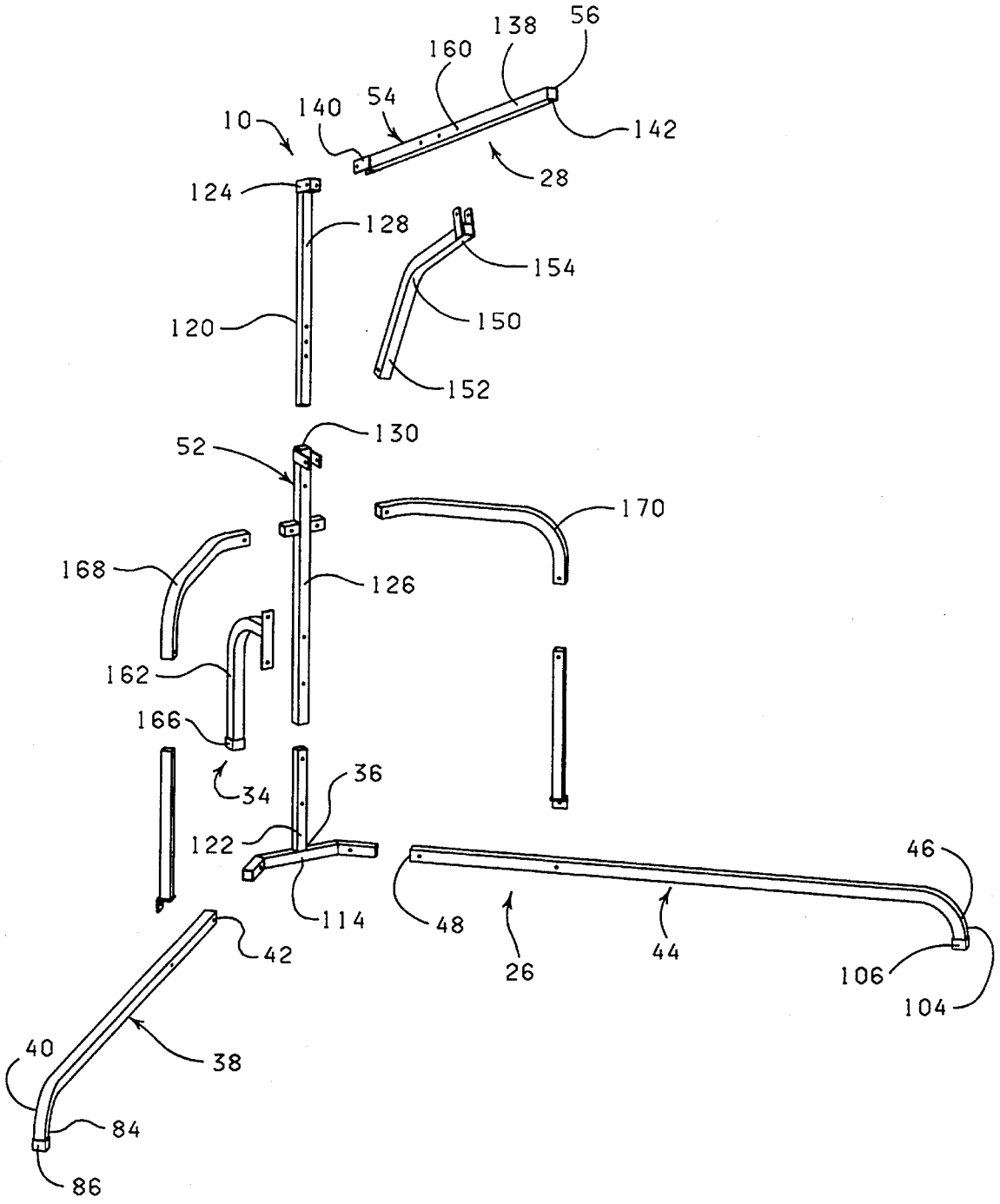
FIG. 2 is an exploded view of the bag holder of FIG. 1.

Referring to the drawings in general and to FIGS. 1 and 2 in particular, shown therein and described by the general reference numeral 10 is a bag holder constructed in accordance with the present invention. The bag holder is adapted to support or hold a training bag 12 shown in dashed lines in FIG. 1.

Figure 5:
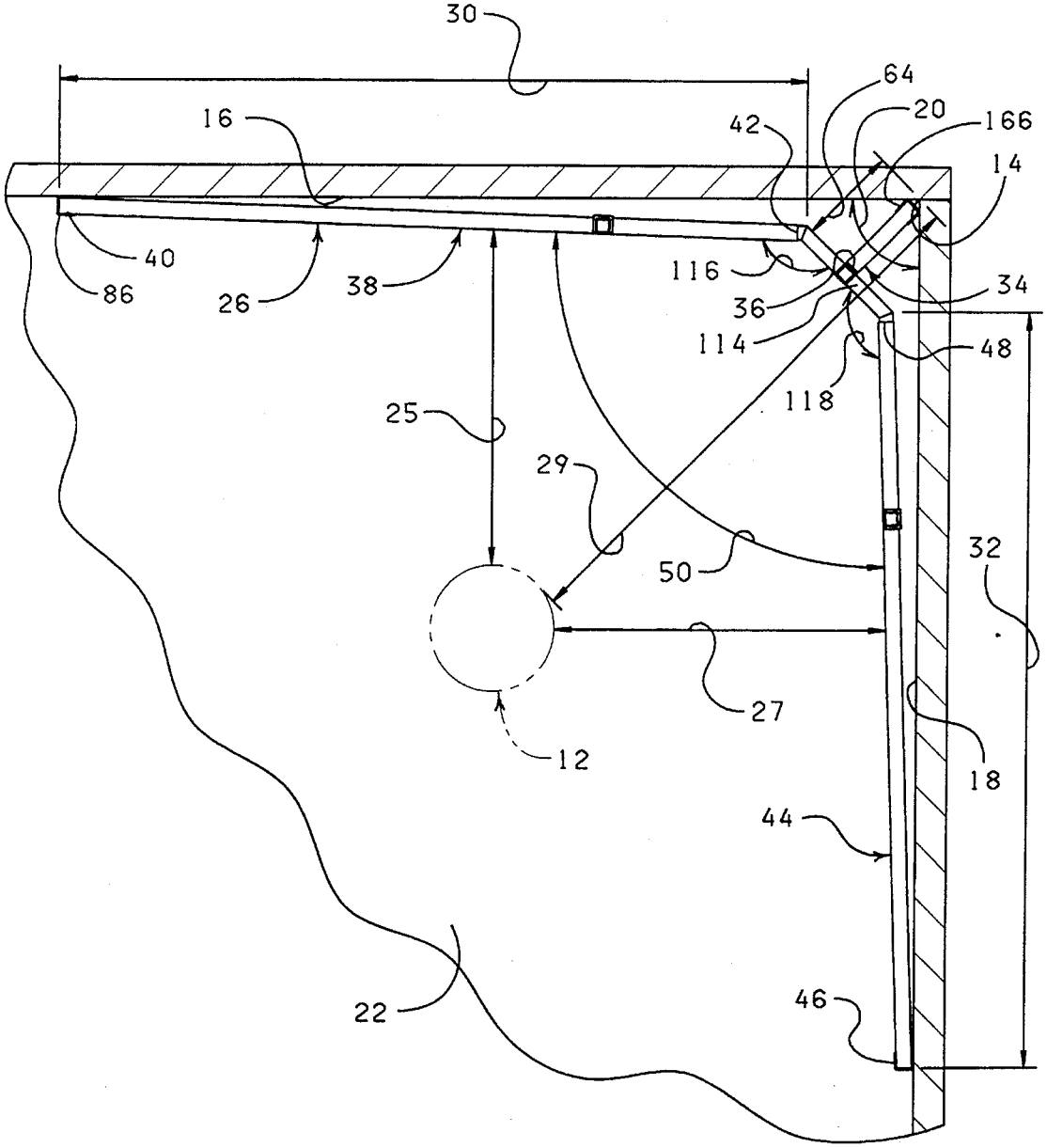
FIG. 5 is a top plan view showing a portion of the leg assembly of the bag holder disposed in a corner formed by the abutment of a first wall and a second wall with the bag holder being supported on a floor surface extending between the first and the second walls.

Referring to FIG. 5, the bag holder 10 particularly is constructed for use in a corner 14 which is defined by the abutment of a first wall 16 and a second wall 18. The first and the second walls 16 and 18 each extend a distance from the corner 14. The first wall 16 is disposed in a plane extending at a wall angle 20 with respect to a plane in which the second wall 18 is disposed. The bag holder 10 is supported in the corner 14 on a floor surface 22 (FIGS. 1 and 5) which is disposed generally between the first and the second walls 16 and 18 with the first and the second walls 16 and 18 each extending a distance upwardly from the floor surface 22. The wall angle 20 generally is about ninety degrees and the first and the second walls 16 and 18 each extend about perpendicularly upwardly from the floor surface 22.

The bag holder 10 supports the training bag 12 at a position spaced a distance 24 (FIG. 1) from the floor surface 22. The bag holder 10 also supports the training bag 12 in a position spaced a distance from the corner 14 and spaced a distance from the first wall 16 and spaced a distance from the second wall 18.

The training bag 12 is designed for kicking and/or punching and/or other contact type maneuvers. Although the training bag 12 is shown in FIGS. 1 and 5 as having a generally elongated cylindrical shape, the bag holder 10 is adapted to support various types of training bags of various shapes and the training bag 12 shown in FIGS. 1 and 5 is for illustration purposes only. Training bags used by individuals for kicking and/or punching and/or other contact type maneuvers in the martial arts or in the art of boxing or other sports are well known in the art and commercially available and a detailed description of such training bags is not deemed necessary herein.

As shown in FIGS. 1, 2 and 5, the bag holder 10 includes a leg assembly 26 and a bag support assembly 28. The leg assembly 26 is disposed or supported on the floor surface 22 in the corner 14 with a portion of the leg assembly 26 extending a distance 30 (FIG. 5) along the first wall 16. Another portion of the leg assembly 26 extends a distance 32 (FIG. 5) along the second wall 18.

The leg assembly 26 includes a corner support 34

(FIGS. 1, 2 and 5) disposed near a corner 36

(FIGS. 1, 2 and 5) of the leg assembly 26. The corner support 34 has a portion which engages the floor surface 22. A portion of the leg assembly 26 engages the floor surface 22 and a portion of the first wall 16 (first point of support), and another portion of the leg assembly 26 engages the floor surface 22 and a portion of the second wall 18 (second point of support) and another portion of the leg assembly 26 comprising the corner support 34 engages the floor surface 22 and a portion of the first and second walls 16 and 18 generally near the corner 14 (third point of support) thereby providing a three point support for the bag holder 10 which enhances the stability of the bag holder 10 during the kicking and/or punching or other contact maneuvers performed by an individual on the training bag 12. The three point support just described includes the three points of support forming a V-shape.

As shown in FIGS. 1, 2 and 5, the leg assembly 26 more particularly comprises a first support leg 38 having a first end 40 and a second end 42. The leg assembly 26 also includes a second support leg 44 having a first end 46 and a second end 48.

The first and the second support legs 38 and 44 and the bag support assembly 28 are constructed and positioned so that the training bag 12 is supported spaced a distance 25 (FIG. 5) from the first wall 16, spaced a distance 27 (FIG. 5) from the second wall 18 and spaced a distance 29 from the corner 36. The distances 25, 27 and 29 are sized so that the individual can work the training bag 12 three hundred sixty degrees (360°) about the training bag 12.

The second end 42 of the first support leg 38 is connected to the second end 48 of the second support leg 44. The first support leg 38 extends at a leg angle 50 (FIG. 5) from the second support leg 44. The leg angle 50 is slightly greater than the wall angle 20. In one embodiment, the wall angle 20 is about ninety degrees (90°) and the leg angle 50 is about ninety-five degrees (95°). The connection between the second end 42 of the first support leg 38 and the second end 48 of the second support leg 44 forms the corner 36 of the leg assembly 26.

As shown in FIGS. 1 and 2, the bag support assembly 28 includes one portion 52 which is connected to at least one of the first support leg 38 and the second support leg 44 near the corner 36 of the leg assembly 26 and another portion 54 which extends a distance outwardly and above the first and the second support legs 38 and 44 terminating with an outward end 56. The training bag 12 more particularly is connected to the bag support assembly 28 near the outward end 56. The bag support assembly 28 extends a distance 58 (FIG. 1) above the first and the second support legs 38 and 44 or, in other words, the distance 58 above the floor surface 22. The distance 58 is sized so that the bag support assembly 28 supports the training bag 12 the predetermined distance 24 above the first and the second support legs 38 and 44 or, in other words, the distance 24 above the floor surface 22.

In operation, the bag holder 10 is disposed in the corner 14 with the corner 36 formed by the leg assembly 26 being disposed near the corner 14. In this position, the first support leg 38 is disposed on the floor surface 22 and is disposed near and spaced a distance from the first wall 16 with the first support leg 38 extending the distance 30 generally from about the corner 14 along the first wall 16. A portion of the first support leg 38 near the first end 40 engages the first wall 16. Further, in this position, the second support leg 44 is disposed near and spaced a distance from the second wall 18, and the second support leg 44 extends the distance 32 along the second wall 18 generally from about the corner 14. A portion of the second support leg 44 near the first end 46 engages the second wall 18. The corner 36 formed by the leg assembly 26 is spaced a distance 64 (FIG. 5) from the corner 14 and the corner support 34 extends into the space formed by the distance 64 between the corner 36 and the corner 14 to a position wherein a portion of the corner support 34 engages a portion of the first and second walls 16 and 18. A portion of the corner support 34 engages the floor surface 22 and portions of the first and second walls 16 and 18 generally near the corner 14 to form the third point of support for the bag holder 10 with the portion of the first support leg 38 engaging the floor surface 22 and a portion of the first wall 16 near the first end 40 of the first support leg 38 forming the first point of support, and a portion of the second support leg 44 engaging the floor surface 22 and a portion of the second wall 18 near the first end 46 of the second support leg 44 forming the second point of support for the bag holder 10. The bag holder 10 is rigid at the three point support but the bag holder 10 is designed to flex at all joints and the tubing is sized to be flexible. The tripod frame of the bag support 10 forming the three point support acts like a spring and absorbs the shock of the weight transferred from the training bag 12 to the bag holder 10.

The bag support assembly 28 supports the training bag 12 the distance 24 above the floor surface 22. The bag support assembly 28 also is sized and positioned to support the training bag 12 spaced the distance 29 from the corner 14, and spaced the distance 27 from the second wall 18 and spaced the distance 25 from the first wall 16. The training bag 12 is movably supported on the bag support assembly 28 so that the training bag 12 may be moved in an upwardly direction, in directions generally outwardly from the corner 14 and in directions generally toward the first wall 16 and in directions generally toward the second wall 18 and in directions generally toward the corner 14 as the training bag is kicked or punched or otherwise engaged by the person using the training bag 12. The three point support provided by the bag holder 10 stabilizes the bag holder 10 and the training bag 12 supported therefrom to substantially prevent movement of the bag holder 10 or tipping of the bag holder 10 as the training bag 12 is so engaged by the individual. The distances 25, 27 and 29 are sized so that the individual is able to work the training bag 12 at any position three hundred sixty degrees (360°) about the training bag 12.

Figure 3:
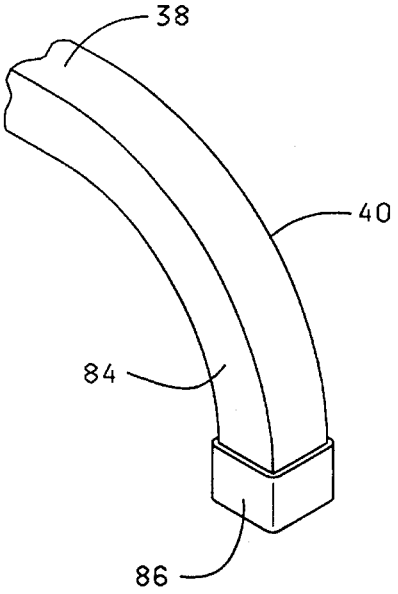
FIG. 3 is an enlarged view of the first end of the first support leg portion of the leg assembly.

A portion of the first support leg 38 near the first end 42 thereof is angled downwardly forming a downwardly extending portion 84 (FIGS. 1, 2 and 3). A rubber or elastomeric block 86 (FIGS. 1, 2 and 3) is secured to the end of the downwardly extending portion 84. The rubber block 86 forms a cushioned support which frictionally engages the floor surface 22 and a portion of the first wall 16 and forms the first point of support. The rubber block 86 frictionally engages the floor surface 22 and a portion of the first wall 16 to prevent slippage for absorbing shock as the training bag 12 is engaged and forces are applied during the operation of the bag holder 10 and during the engagement of the training bag 12.

Figure 3A:
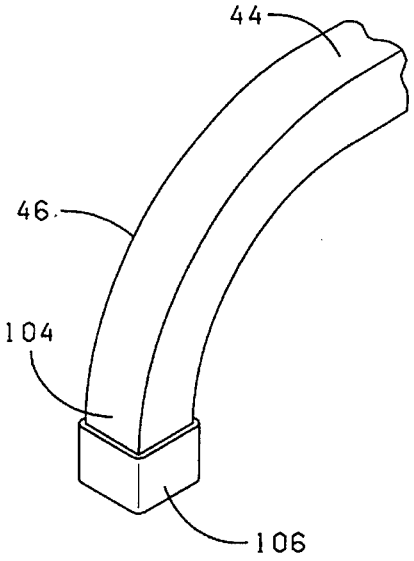
FIG. 3A is an enlarged view of the first end of the second support leg portion of the leg assembly.

A portion of the second support leg 44 near the first end 46 thereof is angled downwardly forming a downwardly extending portion 104 (FIGS. 1, 2 and 3A). A rubber or elastomeric block 106 is secured to the end of the downwardly extending portion 104. The rubber block 106 cushioningly and frictioningly engages the floor surface 22 and a portion of the second wall 18 and forms the second point of support. The rubber block 106 frictionally engages the floor surface 22 and a portion of the second wall 18 to prevent slippage for absorbing shock as the training bag 12 is engaged and forces are applied during the operation of the bag holder 10 and during the engagement of the training bag 12.

A corner bar 114 (FIGS. 1, 2 and 5) more particularly connects the second end 42 of the first support leg 38 to the second end 48 of the second support leg 44. One end of the corner bar 114 is connected to the second end 42 of the first support leg 38 and the opposite end of the corner bar 114 is connected to the second end 48 of the second support leg 44. The corner bar 114 is disposed at an angle 116 (FIG. 5) with respect to the first support leg 38. In one embodiment, the angle 116 is about fifty-seven and five degrees (57.5° ). The corner bar 114 is disposed at an angle 118 with respect to the second support leg 144. In one embodiment, the angle 116 is about 57.5°. In this manner, when the bag holder 10 is positioned in the corner 14 with a portion of the corner support 34 engaging portions of the first and the second 16 and 18 near the corner 14, the first support leg 38 extends angularly from the corner 36 toward the first wall 16 to a position wherein a portion of the first leg support 38 near the first end 40 engages a portion of the first wall 16 and the second support leg 44 extends angularly from the corner 36 toward the second wall 18 to a position wherein the portion of the second support leg 44 near the first end 46 engages a portion of the second wall 18.

Figure 4:
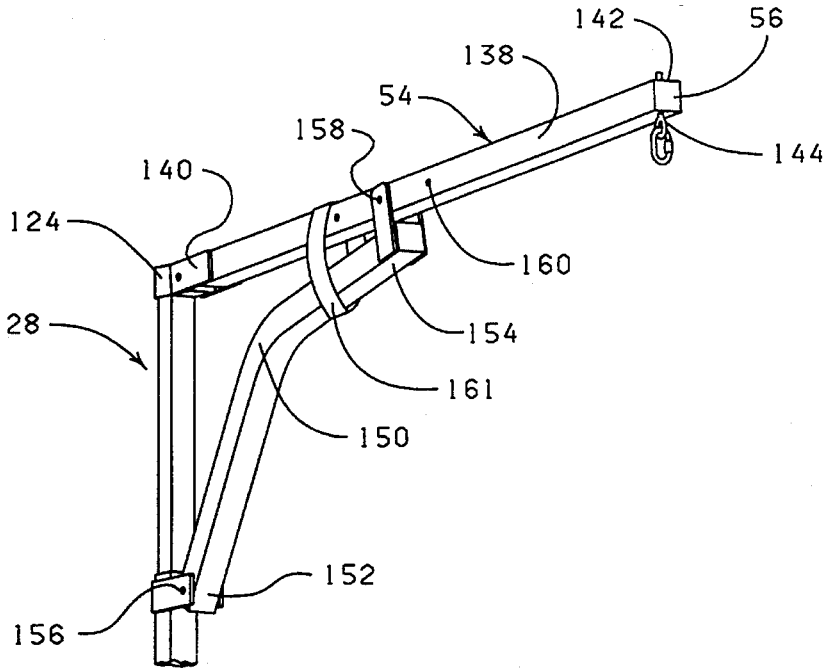
FIG. 4 is an enlarged view of a portion of the bag support assembly of the bag holder.

As shown in FIGS. 1, 2 and 4, the bag support assembly 28 includes an upright bar 120 having a first end 122 and a second end 124. The first end 122 is connected to the corner bar 114 and the upright bar 120 extends a distance upwardly at an angle of about ninety degrees (90°) from the corner bar 114 terminating with the second end 124.

The upright bar 120 more particularly includes a first bar element 126 (FIGS. 1 and 2) and a second bar element 128 (FIGS. 1 and 2). An opening 130 (FIG. 2) is formed at least through one end of the first bar element 126. One end of the second bar element 128 is slidingly disposed in the opening 130 of the first bar element 126 and the first and the second bar elements 126 and 128 are connected together.

The bag support assembly 28 also includes an overhead bar 138 (FIGS. 1, 2 and 4) having a first end 140 and a second end 142. The first end 140 of the overhead bar 138 is pivotally connected to the second end 124 of the upright bar 120 and the overhead bar 138 extends a distance outwardly from the upright bar 120 terminating with the second end 142 of the overhead bar 138. The second end 142 of the overhead bar 138 forms the outward end 56 of the bag support assembly 28.

An O-ring 144 (FIGS. 1 and 4) is secured to the outward end 56 of the bag support assembly 28. The training bag 12 includes a chain assembly 146 (FIG. 1) with a closure link 145. The closure link 145 of the training bag 12 is connected to the 0-ring 144 on the outward end 56 of the bag support assembly 28 for movably connecting the training bag 12 to the bag support assembly 28.

The bag support assembly 28 also includes an angle brace 150 (FIGS. 1, 2 and 4) having a first end 152 and a second end 154. The first end 152 of the angle brace 150 is pivotally connected to the upright bar 120 at a position between the first and the second ends 122 and 124 of the upright bar 120. A bolt 156 (FIGS. 1 and 4) pivotally secures the angle brace 150 to the upright bar 120. The second end 154 of the angle brace 150 is secured to the overhead bar 138 by way of a bolt 158 (FIGS. 1 and 4) at a position generally between the first and the second ends 140 and 142 of the overhead bar 138.

The overhead bar 138 includes a plurality of adjustment openings 160 (FIGS. 1, 2 and 4) spaced along the overhead bar 138 between the first and the second ends 140 and 142 of the overhead bar 138. The second end 154 of the angle brace 150 may be connected to the overhead bar 138 via any one of the adjustment openings 160 in the overhead bar 138 so that the angular disposition of the overhead bar 138 with respect to the upright bar 120 may be adjustingly varied thereby adjustingly varying the distance 58 between the outward end 56 of the bag support assembly and the floor surface 22. Thus, the distance 24 between the training bag 12 and the floor surface 22 may be adjustingly varied by varying the position at which the angle brace 150 is connected to the overhead bar 138.

A strap 161 (FIGS. 1 and 4) is secured about the overhead bar 138 and about the angle brace 150 to hold these components together while adjusting the overhead bar 138. The corner support 34 more particularly includes one end which is secured to the upright bar 120 near the first end 122 thereof. The corner support 34 extends a distance outwardly and downwardly from the upright bar 120 terminating with an outward end 162 (FIGS. 1 and 2), opposite the end of the corner support 34 which is connected to the upright bar 120.

A rubber or elastomeric block 166 (FIGS. 1, 2 and 4) is secured to the outward end 162 of the corner support 34. The rubber block 166 is positioned on the outward end 162 to cushioningly and frictioningly engage the floor surface 22 and a portion of the first and second walls 16 and 18 near the corner 14 to provide the third point of support for the bag holder 10. The cushion effect provided by the rubber block 166 frictionally engages the floor to prevent slippage of the bag holder 10 as the training bag 12 is engaged in the manner described before to prevent slippage of the bag holder 10 along the floor surface 22. The engagement of the rubber block 166 with the floor surface 22 and portions of the first and second walls 16 and 18 substantially prevents tipping or rotation of the bag holder 10 toward the corner 14 as the training bag 12 is engaged in the manners described before.

One end of a first L-shaped support member 168 (FIGS. 1 and 2) is secured to the upright bar 120 at a position between the first end 122 and the second end 124. The opposite end of the first L-shaped support member 168 is secured to the first support leg 38 at a position between the first end 40 and the second end 42.

One end of a second L-shaped support member 170 (FIGS. 1 and 2) is secured to the upright bar 120 at a position generally between the first and the second ends 122 and 124 thereof. The opposite end of the second L-shaped support member 170 is secured to the second support leg 44 at a position between the first and the second ends 46 and 48 thereof. The L-shaped support members 168 and 170 cooperate to provide additional structural support for the upright bar 120 and the overhead bar 138 connected thereto.

The first and the second support legs 38 and 44 and the L-shaped support members 168 and 170 provide structural elements which may be used by the individual for stretching exercises.

The first and the second support legs 38 and 44 extend angularly with respect to each other, as described before, defining an open space between the first and the second support legs 38 and 44. The training bag 12 is disposed over the open space defined between the first and the second support legs 38 and 44. There are no structural members connecting the first and the second support legs 38 and 44 and extending into or through the open space between the first and the second support legs 38 and 44. The open space between the first and the second support legs 38 and 44 defines an area where the individual is free to stand on the floor surface 22 and work the training bag 12 three hundred sixty degrees (360°) about the training bag 12.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A bag holder for supporting a training bag with the bag holder being disposed in a corner defined by the abutment of a first wall and a second wall with the first and the second walls each extending a distance from the corner, and the first wall being disposed in a plane extending at a wall angle with respect to a plane in which the second wall is disposed, and a floor surface being disposed between the first and the second walls with the first and the second walls extending upwardly from the floor surface, the bag holder comprising:

a leg assembly having one portion extending a distance along the first wall and another portion extending a distance along the second wall, the leg assembly being disposed on the floor surface and having a corner disposed near the corner formed by the first and the second walls, the leg assembly further comprising:

a first support leg having a first end and a second end;

a second support leg having a first end and a second end, the second end of the second support leg being connected only to the second end of the first support leg with the connection of the second end of the first support leg to the second end of the second support leg forming the corner of the leg assembly, the first support leg extending at a leg angle with respect to the second support leg, the leg angle being greater than the wall angle; and a corner bar having one end connected to the second end of the first support leg and an opposite end connected to the second end of the second support leg, the corner bar providing the connection between the second end of the first support leg and the second end of the second support leg, the corner bar extending at an angle from the first support leg and at an angle from the second support leg, the corner bar being disposed at the corner of the leg assembly; and a bag support assembly connected to the leg assembly near the corner of the leg assembly, a portion of the bag support assembly extending a distance upwardly from the leg assembly and another portion of the bag support assembly extending a distance outwardly over and above the leg assembly terminating with an outward end of the bag support assembly, the outward end of the bag support assembly being disposed a distance above the floor surface, and the bag support assembly including means for connecting the training bag to the bag support assembly near the outward end of the bag support assembly with the training bag being supported a distance above the leg assembly and above the floor surface by the bag support assembly.

2. The bag holder of claim 1 wherein the bag support assembly is defined further as being adjustable for adjustably varying the distance the outward end of the bag support assembly extends above the floor surface.

3. The bag holder of claim 1 wherein the corner of the leg assembly is defined further as being spaced a distance from the corner formed by the first and the second walls when the bag holder is positioned between the first and the second walls.

4. The bag holder of claim 1 wherein the first support leg further comprises:

means for engaging the floor surface and a portion of the first wall and providing a first point of support; and wherein the second support leg further comprises:

means for engaging the floor surface and a portion of the second wall and providing a second point of support; and wherein the leg assembly further comprises means for engaging the floor surface near the corner of the leg assembly and a portion of the first wall and a portion of the second wall near the corner formed by the first and second walls and providing a third point of support, the first point of support and the second point of support and the third point of support providing a V-shaped three point support for the bag holder.

5. The bag holder of claim 4 wherein the means for engaging the floor surface and a portion of the first wall and forming the first point of support is further defined as being disposed near the first end of the first support leg, and wherein the means for engaging the floor surface and a portion of the second wall and forming the second point of support is defined further as being disposed near the first end of the second support leg.

6. The bag holder of claim 1 wherein the bag support assembly further comprises:

an upright bar having a first end and a second end, the first end of the upright bar being connected to the leg assembly and the upright bar extending a distance upwardly from the first and the second support legs terminating with the second end of the upright bar; and an overhead bar having a first end and a second end, the first end of the overhead bar being connected to the second end of the upright bar and the overhead bar extending a distance outwardly from the upright bar terminating with the second end of the overhead bar, the second end of the overhead bar forming the outward end of the bag support assembly.

7. The bag holder of claim 6 wherein the outward end of the bag support assembly extends a distance above the floor surface, and wherein the bag support assembly includes means for varying the distance the outward end of the bag support assembly extends above the floor surface.

8. The bag holder of claim 6 wherein the first end of the overhead bar is defined further as being pivotally connected to the second end of the upright bar, and wherein the bag support assembly further comprises:

an angle brace having a first end and a second end, the first end of the angle brace being pivotally connected to the upright bar at a position between the first and the second ends of the upright bar, and the second end of the angle brace being connected to the overhead bar at a position between the first and the second ends of the overhead bar.

9. The bag holder of claim 8 wherein the second end of the angle brace is defined further as being connected to the overhead bar at various positions between the first and the second ends of the overhead bar for adjustably varying the distance at which the outward end of the bag support assembly extends above the floor surface.

10. The bag holder of claim 1 wherein the bag support assembly is defined further as having the outward end thereof positioned to support the training bag spaced a distance from the corner of the leg assembly and spaced a distance from the first support leg and spaced a distance from the second support leg, and wherein the first support leg is connected to the second support leg only at the connection between the second end of the first support leg and the second end of the second support leg with an area being defined between the first support leg and the second support leg with no structures disposed therein other than the floor surface whereby the individual standing and moving on the floor surface is able to move and work the training bag three hundred sixty degrees (360°) about the training bag while standing on the floor surface.

11. A bag holder supportable on a floor surface for supporting a training bag comprising:

a leg assembly comprising:

a first support leg having a first end and a second end;

a second support leg having a first end and a second end, the second end of the first support leg being connected to the second end of the second support leg and the first support leg extending at a leg angle greater than ninety degrees with respect to the second support leg, the connection between the second end of the first support leg and the second end of the second support leg defining a corner of the leg assembly; and a corner bar having one end connected to the second end of the first support leg and an opposite end connected to the second end of the second support leg, the corner bar providing the connection between the second end of the first support leg and the second end of the second support leg, the corner bar extending at an angle from the first support leg and at an angle from the second support leg, the corner bar being disposed at the corner of the leg assembly; and a bag support assembly connected to the leg assembly near the corner of the leg assembly, a portion of the bag support assembly extending a distance upwardly from the leg assembly and another portion of the bag support assembly extending a distance outwardly over and above the leg assembly terminating with an outward end of the bag support assembly, the outward end of the bag support assembly being disposed a distance above the leg assembly, and the bag support assembly including means for connecting the training bag to the bag support assembly near the outward end of the bag support assembly with the training bag being supported a distance above the leg assembly, the first support leg being connected to the second support leg only at the connection of the second end of the first support leg to the second end of the second support leg with an area being defined between the corner support extending a distance outwardly and downwardly from the upright bar; and means on the end of the corner support, opposite the end thereof connected to the upright bar, for engaging the floor surface and providing a third point of support with the first point of support and the second point of support and the third point of support being positioned to provide a V-shaped three point support for the bag holder.

12. The bag holder of claim 11 wherein the first support leg further comprises:

means for engaging the floor surface and providing a first point of support; and wherein the second support leg further comprises:

means for engaging the floor surface and providing a second point of support; and wherein the leg assembly further comprises means for engaging the floor surface near the corner of the leg assembly and providing a third point of support, the first point of support and the second point of support and the third point of support providing a V-shaped three point support for the bag holder.

13. The bag holder of claim 12 wherein the means for engaging the floor surface and forming the first point of support is further defined as being disposed near the first end of the first support leg, and wherein the means for engaging the floor surface and forming the second point of support is defined further as being disposed near the first end of the second support leg.

14. The bag holder of claim 11 wherein the bag support assembly further comprises:

an upright bar having a first end and a second end, the first end of the upright bar being connected to at least one of the first and the second support legs and the upright bar extending a distance upwardly from the first and the second support legs terminating with the second end of the upright bar; and an overhead bar having a first end and a second end, the first end of the overhead bar being connected to the second end of the upright bar and the overhead bar extending a distance outwardly from the upright bar terminating with the second end of the overhead bar, the second end of the overhead bar forming the outward end of the bag support assembly.

15. The bag holder of claim 14 wherein the outward end of the bag support assembly extends a distance above the floor surface and wherein the bag support assembly includes means for varying the distance the outward end of the bag support assembly extends above the floor surface.

16. The bag holder of claim 15 wherein the first end of the overhead bar is defined further as being pivotally connected to the second end of the upright bar, and wherein the bag support assembly further comprises:

an angle brace having a first end and a second end, the first end of the angle brace being pivotally connected to the upright bar at a position between the first and the second ends of the upright bar, and the second end of the angle bar being connected to the overhead bar at a position between the first and the second ends of the overhead bar.

17. The bag holder of claim 16 wherein the second end of the angle brace is defined further as being connected to the overhead bar at various positions between the first and the second ends of the overhead bar for adjustably varying the distance at which the outward end of the bag support assembly extends above the floor surface.

18. The bag holder of claim 16 wherein the first support leg further comprises:

means for engaging the floor surface and providing a first point of support; and wherein the second support leg further comprises:

means for engaging the floor surface and providing a second point of support; and wherein the leg assembly further comprises means for engaging the floor surface near the corner of the leg assembly and providing a third point of support, the first point of support and the second point of support and the third point of support providing a V-shaped three point support for the bag holder; and wherein the leg assembly further comprises:

a corner support having one end connected to the upright bar at a position between the first and the second ends of the upright bar, the corner support extending a distance outwardly and downwardly from the upright bar; and means on the end of the corner support, opposite the end thereof connected to the upright bar, for engaging the floor surface and providing a third point of support with the first point of support and the second point of support and the third point of support being positioned to provide a V-shaped three point support for the bag holder.

19. A bag holder adapted to be used in conjunction with a first wall and a second wall having a corner defined between the first wall and the second wall with the bag holder being supportable on a floor surface for supporting a training bag, the first wall extending at a wall angle with respect to the second wall, the bag holder comprising:

a leg assembly comprising:

a first support leg having a first end and a second end, the first support leg comprising means on the support leg near the first end thereof for engaging the floor surface and engaging a portion of the first wall for providing a first point of support; and a second support leg having a first end and a second end, the second end of the first support leg being connected to the second end of the second support leg and the first support leg extending at a leg angle greater than the wall angle with respect to the second support leg, the connection between the second end of the first support leg and the second end of the second support leg defining a corner, the second support leg comprising a means near the first end of the second support leg for engaging the floor surface and a portion of the second wall for providing a second point of support; and a bag support assembly connected to the leg assembly near the corner of the leg assembly a portion of the bag support assembly extending a distance upwardly from the leg assembly and another portion of the bag support assembly extending a distance outwardly over and above the leg assembly terminating with an outward end of the bag support assembly, the outward end of the bag support assembly being disposed a distance above the leg assembly, and the bag support assembly including means for connecting the training bag to the bag support assembly near the outward end of the bag support assembly with the training bag being supported a distance above the leg assembly, the first support leg being connected to the second support leg only via the connection between the second end of the first support leg to the second end of the second support leg with an area being defined between the first and the second support legs with no structures being disposed in said area and the bag assembly being further defined to support the training bag above said area spaced a distance from the corner of the leg assembly and spaced a distance from the first support leg and spaced a distance from the second support leg whereby an individual standing and moving in said area can work the training bag three hundred sixty degrees (360°) about the training bag, comprising:

an upright bar having a first end and a second end, the first end of the upright bar being connected to the leg assembly and the upright bar extending a distance upwardly from the first and the second support legs terminating with the second end of the upright bar; and an overhead bar having a first end and a second end, the first end of he overhead bar being connected to the second end of the upright bar and the overhead bar extending a distance outwardly from the upright bar terminating with the second end of the overhead bar, the second end of the overhead bar forming the outward end of the bag support assembly; and wherein the leg assembly further comprises means for engaging the floor surface near the corner of the leg assembly and for engaging at least one of the first and second walls near the corner defined by the first and the second walls for providing a third point of support, the first point of support and the second point of support and the third point of support providing a V-shaped three point support for the bag holder, the first end of the overhead bar is defined further as being pivotally connected to the second end of the upright bar; and an angle brace having a first end and a second end, the first end of the angle brace being pivotally connected to the upright bar at a position between the first and the second ends of the upright bar, and the second end of the angle bar being connected to the overhead bar at a position between the first and the second ends of the overhead bar.

20. The bag holder of claim 19 wherein the outward end of the bag support assembly extends a distance above the floor surface and wherein the bag support assembly includes means for varying the distance the outward end of the bag support assembly extends above the floor surface.

21. The bag holder of claim 19 wherein the second end of the angle brace is defined further as being connected to the overhead bar at various positions between the first and the second ends of the overhead bar for adjustably varying the distance at which the outward end of the bag support assembly extends above the floor surface.

22. The bag holder of claim 19 wherein the leg assembly further comprises a corner bar having one end connected to the second end of the first support leg and an opposite end connected to the second end of the second support leg, the corner bar providing the connection between the second end of the first support leg and the second end of the second support leg, the corner bar extending at an angle from the first support leg and at an angle from the second support leg, the corner bar being disposed at the corner of the leg assembly.

23. A bag holder for supporting a training bag with the bag holder being disposed in a corner defined by the abutment of a first wall and a second wall with the first and the second walls each extending a distance from the corner, and the first wall being disposed in a plane extending at a wall angle with respect to a plane in which the second wall is disposed, and a floor surface being disposed between the first and the second walls with the first and the second walls extending upwardly from the floor surface, the bag holder comprising:

a leg assembly having one portion extending a distance along the first wall and another portion extending a distance along the second wall, the leg assembly being disposed on the floor surface and having a corner disposed near the corner formed by the first and the second walls, the leg assembly further comprising:

a first support leg having a first end and a second end; and a second support leg having a first end and a second end, the second end of the second support leg being connected only to the second end of the first support leg with the connection of the second end of the first support leg to the second end of the second support leg forming the corner of the leg assembly, the first support leg extending at a leg angle with respect to the second support leg, the leg angle being greater than the wall angle; and a bag support assembly connected to the leg assembly near the corner of the leg assembly, a portion of the bag support assembly extending a distance upwardly from the leg assembly and another portion of the bag support assembly extending a distance outwardly over and above the leg assembly terminating with an outward end of the bag support assembly, the outward end of the bag support assembly being disposed a distance above the floor surface, and the bag support assembly including means for connecting the training bag to the bag support assembly near the outward end of the bag support assembly with the training bag being supported a distance above the leg assembly and above the floor surface by the bag support assembly, the bag support assembly further comprising:

an upright bar having a first end and a second end, the first end of the upright bar being connected to the leg assembly and the upright bar extending a distance upwardly from the first and the second support legs terminating with the second end of the upright bar; and an overhead bar having a first end and a second end, the first end of the overhead bar being connected to the second end of the upright bar and the overhead bar extending a distance outwardly from the upright bar terminating with the second end of the overhead bar, the second end of the overhead bar forming the outward end of the bag support assembly, the first end of the overhead bar is defined further as being pivotally connected to the second end of the upright bar; and angle brace having a first end and a second end, the first end of the angle brace being pivotally connected to the upright bar at a position between the first and-the second ends of the upright bar, and the second end of the angle brace being connected to the overhead bar at a position between the first and the second ends of the overhead bar.

24. The bag holder of claim 23 wherein the second end of the angle brace is defined further as being connected to the overhead bar at various positions between the first and the second ends of the overhead bar for adjustably varying the distance at which the outward end of the bag support assembly extends above the floor surface.

25. The bag holder of claim 23 wherein the first support leg further comprises:

means for engaging the floor surface and the first wall and providing a first point of support, and wherein the second support leg further comprises:

means for engaging the floor surface and the second wall and providing a second point of support; and means for engaging the floor surface near the corner of the leg assembly and engaging portions of the first and second walls and providing a third point of support, the first point of support and the second point of support and the third point of support providing a V-shaped three point support for the bag holder, comprising:

a corner support having one end connected to the upright bar at a position between the first and the second ends of the upright bar, the corner support extending a distance outwardly and downwardly from the upright bar; and means on the end of the corner support, opposite the end thereof connected to the upright bar, for engaging the floor surface and portions of the first and second walls and providing the third point of support.

26. A bag holder supportable on a floor surface for supporting a training bag comprising:

a leg assembly comprising:

a first support leg having a first end and a second end; and a second support leg having a first end and a second end, the second end of the first support leg being connected to the second end of the second support leg and the first support leg extending at a leg angle greater than ninety degrees with respect to the second support leg, the connection between the second end of the first support leg and the second end of the second support leg defining a corner of the leg assembly; and a bag support assembly connected to the leg assembly near the corner of the leg assembly, a portion of the bag support assembly extending a distance upwardly from the leg assembly and another portion of the bag support assembly extending a distance outwardly over and above the leg assembly terminating with an outward end of the bag support assembly, the outward end of the bag support assembly being disposed a distance above the leg assembly, and the bag support assembly including means for connecting the training bag to the bag support assembly near the outward end of the bag support assembly with the training bag being supported a distance above the leg assembly, the first support leg being connected to the second support leg only at the connection of the second end of the first support leg to the second end of the second support leg with an area being defined between the first support leg and the second support leg and no structures being disposed in said area, the bag support assembly supporting the training bag over and spaced a distance above said area with the training bag being spaced a distance from the corner of the leg assembly and being spaced a distance from the first support leg and being spaced a distance from the second support leg whereby an individual standing in said area can move and work the training bag three hundred sixty degrees (360°) about the training bag, the outward end of the bag support assembly extends a distance above the floor surface and wherein the bag support assembly includes means for varying the distance the outward end of the bag support assembly extends above the floor surface, the bag support assembly further comprising:

an upright bar having a first end and a second end, the first end of the upright bar being connected to the leg assembly and the upright bar extending a distance upwardly from the first and the second support legs terminating with the second end of the upright bar;

an overhead bar having a first end and a second end, the first end of the overhead bar being connected to the second end of the upright bar and the overhead bar extending a distance outwardly from the upright bar terminating with the second end of the overhead bar, the second end of the overhead bar forming the outward end of the bag support assembly, the first end of the overhead bar is defined further as being pivotally connected to the second end of the upright bar; and an angle brace having a first end and a second end, the first end of the angle brace being pivotally connected to the upright bar at, a position between the first and the second ends of the upright bar, and the second end of the angle bar being connected to the overhead bar at a position between the first and the second ends of the overhead bar.

27. The bag holder of claim 26 wherein the second end of the angle bar is defined further as being connected to the overhead bar at various positions between the first and the second ends of the overhead bar for adjustably varying the distance at which the outward end of the bag support assembly extends above the floor surface.

28. The bag holder of claim 26 wherein the first support leg further comprises:

means for engaging the floor surface and providing a first point of support; and wherein the second support leg further comprises:

means for engaging the floor surface and providing a second point of support; and wherein the leg assembly further comprises means for engaging the floor surface near the corner of the leg assembly and providing a third point of support, the first point of support and the second point of support and the third point of support providing a V-shaped three point support for the bag holder; and wherein the leg assembly further comprises:

a corner support having one end connected to the upright bar at a position between the first and the second ends of the upright bar, the corner support extending a distance outwardly and downwardly from the upright bar; and means on the end of the corner support, opposite the end thereof connected to the upright bar, for engaging the floor surface and providing a third point of support with the first point of support and the second point of support and the third point of support being positioned to provide a V-shaped three point support for the bag holder.

29. A bag holder adapted to be used in conjunction with a first wall and a second wall having a corner defined between the first wall and the second wall with the bag holder being supportable on a floor surface for supporting a training bag, the first wall extending at a wall angle with respect to the second wall, the bag holder comprising:

a first support leg having a first end and a second end, the first support leg comprising means on the support leg near the first end thereof for engaging the floor surface and engaging a portion of the first wall for providing a first point of support;

a second support leg having a first end and a second end, the second end of the first support leg being connected to the second end of the second support leg and the first support leg extending at a leg angle greater than the wall angle with respect to the second support leg, the connection between the second end of the first support leg and the second end of the second support leg defining a corner, the second support leg comprising means near the first end of the second support leg for engaging the floor surface and a portion of the second wall for providing a second point of support;

a bag assembly connected to the leg assembly near the corner of the leg assembly, a portion of the bag support assembly extending a distance upwardly from the leg assembly and another portion of the bag support assembly extending a distance outwardly over and above the leg assembly terminating with an outward end of the bag support assembly, the outward end of the bag support assembly being disposed a distance above the leg assembly, and the bag support assembly including means for connecting the training bag to the bag support assembly near the outward end of the bag support assembly with the training bag being supported a distance above the leg assembly, the first support leg being connected to the second support leg only via the connection between the second end of the first support leg to the second end of the second support leg with an area being defined between the first and the second support legs with no structures being disposed in said area and the bag assembly being further defined to support the training bag above said area spaced a distance from the corner of the leg assembly and spaced a distance from the first support leg and spaced a distance from the second support leg whereby an individual standing and moving in said area can work the training bag three hundred sixty degrees (360°) about the training bag, comprising:

an upright bar having a first end and a second end, the first end of the upright bar being connected to the leg assembly and the upright bar extending a distance upwardly from the first and the second support legs terminating with the second end of the upright bar; and an overhead bar having a first end and a second end, the first end of the overhead bar being connected to the second end of the upright bar and the overhead bar extending a distance outwardly from the upright bar terminating with the second end of the overhead bar, the second end of the overhead bar forming the outward end of the bag support assembly; and wherein the leg assembly further comprises means for engaging the floor surface near the corner of the leg assembly and for engaging at least one of the first and second walls near the corner defined by the first and the second walls for providing a third point of support, the first point of support and the second point of support and the third point of support providing a V-shaped three point support for the bag holder, the means for forming the third point of support further comprising:

a corner support having one end connected to the upright bar at a position between the first and the second ends of the upright bar, the corner support extending a distance outwardly and downwardly from the upright bar; and means on the end of the corner support, opposite the end thereof connected to the upright bar, for engaging the floor surface and a portion of at least one of the first wall and the second wall and providing the third point of support.

* * * * *

UNITED STATES PATENT AND TRADEMARK OFFICE

CERTIFICATE OF CORRECTION

PATENT NO. : 5,460,343

DATED : October 24, 1995

INVENTOR(S) : Hestilow

It is certified that error appears in the above-identified patent and that said Letters Patent is hereby corrected as shown below:

Column 3, line 58, please delete "first end 42" and substitute therefor --first end 40--.

Column 4, line 25, please delete "fifty-seven and five degrees (57.5°) and substitute therefor --57.5°--.

Column 4, line 27, please delete "second support leg 144" and substitute therefor --second support leg 44--.

Column 4, line 30, after "second" please insert --walls--.

Column 10, line 47, after "assembly" please insert --,--.

Column 12, line 47, before "angle" please insert --an--.

Column 14, line 13, after "at" please delete ",".

Signed and Sealed this

Twelfth Day of March, 1996

*Attest:*

*Attesting Officer*

Bruce Lehman

BRUCE LEHMAN

*Commissioner of Patents and Trademarks*